US006691788B1

(12) United States Patent
Dearing

(10) Patent No.: US 6,691,788 B1
(45) Date of Patent: Feb. 17, 2004

(54) RETRIEVABLE PACKER HAVING A POSITIVELY OPERATED SUPPORT RING

(75) Inventor: David G. Dearing, Carrollton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 27 days.

(21) Appl. No.: 10/202,694

(22) Filed: Jul. 25, 2002

(51) Int. Cl.[7] ..... E21B 23/01

(52) U.S. Cl. ..... 166/382; 166/387; 166/119; 166/134; 166/217; 166/138; 166/196; 166/137; 166/334.1

(58) Field of Search ..... 166/387, 119, 166/134, 217, 138, 196, 382, 137, 215, 216, 332.1, 332.4, 334.1

(56) References Cited

U.S. PATENT DOCUMENTS 3,570,596 A 3/1971 Young ..... 166/129
4,281,840 A * 8/1981 Harris ..... 277/342
4,457,369 A * 7/1984 Henderson ..... 166/125
4,633,943 A * 1/1987 Zunkel ..... 166/51
5,311,938 A 5/1994 Hendrickson et al. ..... 166/134
6,302,217 B1 10/2001 Kilgore et al. ..... 166/134
6,318,460 B1 11/2001 Swor et al. ..... 166/138
6,378,606 B1 4/2002 Swor et al. ..... 166/217

* cited by examiner

*Primary Examiner*—Roger Schoeppel
(74) *Attorney, Agent, or Firm*—Lawrence R. Youst; Scott F. Wendorf

(57) ABSTRACT

A retrievable packer (50) for establishing a sealing and gripping engagement between a tubing string and a well casing (34) disposed in a wellbore is disclosed. The retrievable packer (50) comprises a collet member (64) that is slidably disposed about a packer mandrel (52). The collet member (64) has a first operating position wherein the collet member (64) applies an axial force on a support ring (76) to positively position the support ring (76) at least partially between a first slip wedge (90) and the packer mandrel (52) to set a seal assembly (96, 98, 100). In addition, the collet member (64) has a second operating position wherein the collet member (64) applies an axial force on a slip assembly (80) to set the slip assembly (80).

43 Claims, 5 Drawing Sheets

RETRIEVABLE PACKER HAVING A POSITIVELY OPERATED SUPPORT RING

TECHNICAL FIELD OF THE INVENTION

This invention relates, in general, to tools and equipment for completing a subterranean well that traverses a hydrocarbon bearing formation and, in particular, to a retrievable well packer for releasably sealing the annulus between a tubing string and the well casing using a collet member to positively operate a support ring.

BACKGROUND OF THE INVENTION

In the course of treating and preparing a subterranean well for production, a well packer is run into the well on a conveyance such as a work string, a production tubing, a wireline or the like. The purpose of the packer is to support production tubing and other completion equipment, such as a sand control screen adjacent to a producing formation, and to seal the annulus between the outside of the production tubing and the inside of the well casing to block movement of fluids through the annulus past the packer location.

Typically, the packer is provided with an upper and a lower set of anchor slips having opposed camming surfaces which cooperate with complementary opposed wedging surfaces, whereby the anchor slips are outwardly radially extendable into gripping engagement against the well casing bore in response to relative axial movement of the wedging surfaces. The packer also carries annular seal elements which are expandable radially into sealing engagement against the bore of the well casing in response to axial compression forces. The longitudinal movement of the packer components which set the anchor slips and the sealing elements may be produced, for example, hydraulically or mechanically.

After the packer has been set within the well casing, it should maintain its sealing and griping engagement upon removal of the hydraulic or mechanical setting force. Additionally, it is essential that the packer remain locked in its set configuration while withstanding hydraulic pressures applied externally or internally from the formation and/or manipulation of the tubing string and service tools without unsetting the packer or interrupting the seal. This is made more difficult in deep wells in which the packer and its components are subjected to high downhole temperatures and high downhole pressures.

Moreover, the packer should be able to withstand variation of externally applied hydraulic pressures at levels such as 10,000 psi in both directions, and still be retrievable after such exposure for long periods of time such as 10 to 15 years or more. After such long periods of extended service under extreme pressure and temperature conditions, it is desirable that the packer be retrievable from the well by appropriate manipulation of the tubing string, such as a quarter turn of rotation, to cause the packer to be released and unsealed from the well casing, with the anchor slips and seal elements being retracted sufficiently to avoid becoming stuck within wellbore restrictions.

It has been found, however, that in certain packer deployments, the deviation of the wellbore may cause the packer to rest on the inside of the well casing. In these deployments, it is difficult to properly set the upper anchor slips due to a lack of cooperation of the opposed camming surfaces of the upper anchor slips with the complementary opposed wedging surfaces as the force of gravity cannot fully act on the support ring. Therefore, a need has arisen for a retrievable packer that is capable of being properly deployed in a well wherein the packer rests on the inside of the well casing. A need has also arisen for such a retrievable packer that is capable of withstanding the extreme downhole pressures and temperatures without unsetting the packer or interrupting the seal. Further, a need has arisen for such a retrievable packer that is capable of being set, unset and reset in the well casing and remaining in the well for long periods of extended service then be retrieved from the well.

SUMMARY OF THE INVENTION

The present invention disclosed herein comprises a retrievable packer that is capable of being properly deployed in a well wherein the packer rests on the inside of the well casing. The retrievable packer of the present invention is also capable of withstanding the extreme downhole pressures and temperatures without unsetting the packer or interrupting the seal. In addition, the retrievable packer of the present invention is capable of being set, unset and reset in the well casing and remaining in the well for long periods of extended service and later being retrieved from the well.

The retrievable packer of the present invention comprises a packer mandrel that is adapted for connection to a tubing string. A seal assembly is disposed about the packer mandrel. The seal assembly has a running position, wherein the seal assembly is not in sealing engagement with the well casing, and a sealing position, wherein the seal assembly is in sealing engagement with the well casing. A first slip wedge is slidably disposed about the packer mandrel. The first slip wedge is operably associated with the slip assembly and may include plurality of wedge sections.

The retrievable packer of the present invention also includes a support ring that is slidably disposed about the packer mandrel. The support ring is operably positionable at least partially between the first slip wedge and the packer mandrel to prevent radially inward travel of the first slip wedge and to apply an axial force on the first slip wedge to operate the seal assembly from the running position to the sealing position. A slip assembly is slidably disposed about the support ring. The slip assembly is operably associated with the first slip wedge and has a running position, wherein the slip assembly is not in gripping engagement with the well casing, and a gripping position, wherein the slip assembly is radially outwardly extended by contact with the first slip wedge into gripping engagement with the well casing.

In addition, the retrievable packer of the present invention includes a collet member that is slidably disposed about the packer mandrel. The collet member has a first operating position, wherein the collet member applies an axial force on the support ring to positively position the support ring at least partially between the first slip wedge and the packer mandrel, and a second operating position, wherein the collet member applies an axial force on the slip assembly to operate the slip assembly from the running position to the gripping position.

The seal assembly of the retrievable packer of the present invention may include a mandrel element slidably disposed about the packer mandrel, a second slip wedge slidably disposed about the mandrel element and at least one seal element disposed about the mandrel element such that a compressive force between the mandrel element and the second slip wedge radially expands the seal element. Likewise, the slip assembly of the retrievable packer of the present invention may include a slip carrier and a plurality of slips that are radially outwardly extendable, by contact with the first slip wedge, into gripping engagement with the well casing.

The collet member may include a plurality of collet fingers that are radially retracted when the collet member is in the first operating position and radially expanded when the collet member is in the second operating position. In addition, the collet member may comprise a spring cover.

It should be noted that the retrievable packer of the present invention may be set, unset and reset any number of times. Specifically, the seal assembly of the retrievable packer of the present invention can be repetitively operated between its running position and its sealing position without removing the packer from the well casing. Likewise, the slip assembly of the retrievable packer of the present invention can be repetitively operated between its running position and its gripping position without removing the packer from the well casing.

In another aspect, the present invention comprises a method of setting a retrievable packer to establish a sealing and gripping engagement with a well casing. This method includes lowering the packer into the well casing to a selected location, axially shifting a packer mandrel within the packer, positively positioning a support ring at least partially between a first slip wedge and the packer mandrel by applying an axial force on the support ring with a collet member, operating a seal assembly from a running position wherein the seal assembly is not in sealing engagement with the well casing to a sealing position wherein the seal assembly is in sealing engagement with the well casing, repositioning the collet member to apply the axial force on a slip assembly and operating the slip assembly from a running position wherein the slip assembly is not in gripping engagement with the well casing to a gripping position wherein the slip assembly is radially outwardly extended by contact with the first slip wedge into gripping engagement with the well casing.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
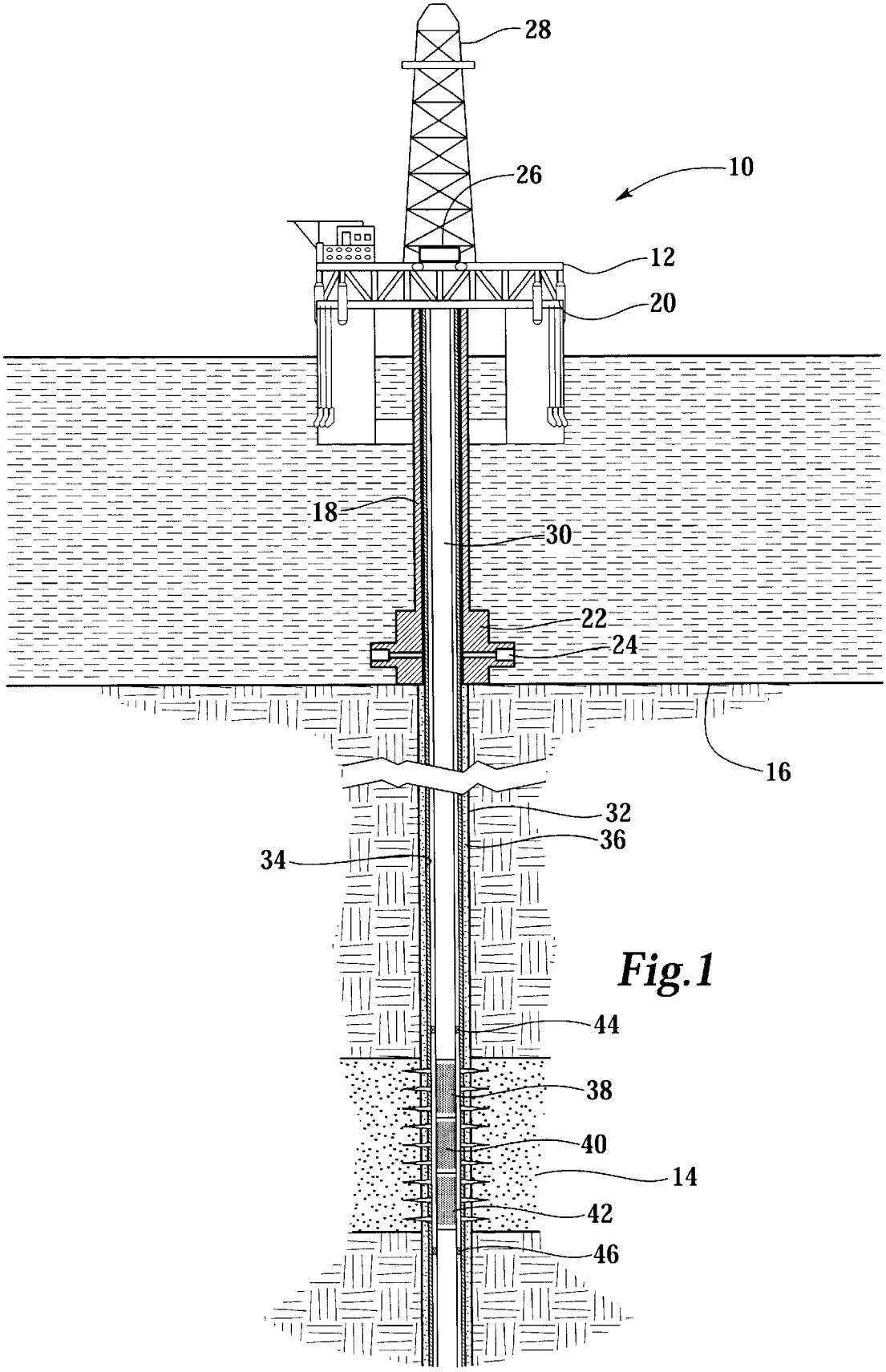
FIG. 1 is a schematic illustration of an offshore oil and gas platform operating a pair of retrievable packers of the present invention.

Referring initially to FIG. 1, a pair of retrievable packers operating from an offshore oil and gas platform are schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is cemented within wellbore 32 by cement 36. Work string 30 includes various tools including sand control screens 38, 40, 42 positioned in an interval of wellbore 32 adjacent to formation 14 between retrievable packers 44, 46 of the present invention.

Importantly, even though FIG. 1 depicts a vertical well, it should be noted by one skilled in the art that the retrievable packers of the present invention are equally well-suited for use in deviated wells, inclined wells or horizontal wells. Also, even though FIG. 1 depicts an offshore operation, it should be noted by one skilled in the art that the retrievable packers of the present invention are equally well-suited for use in onshore operations.

Figure 2A:
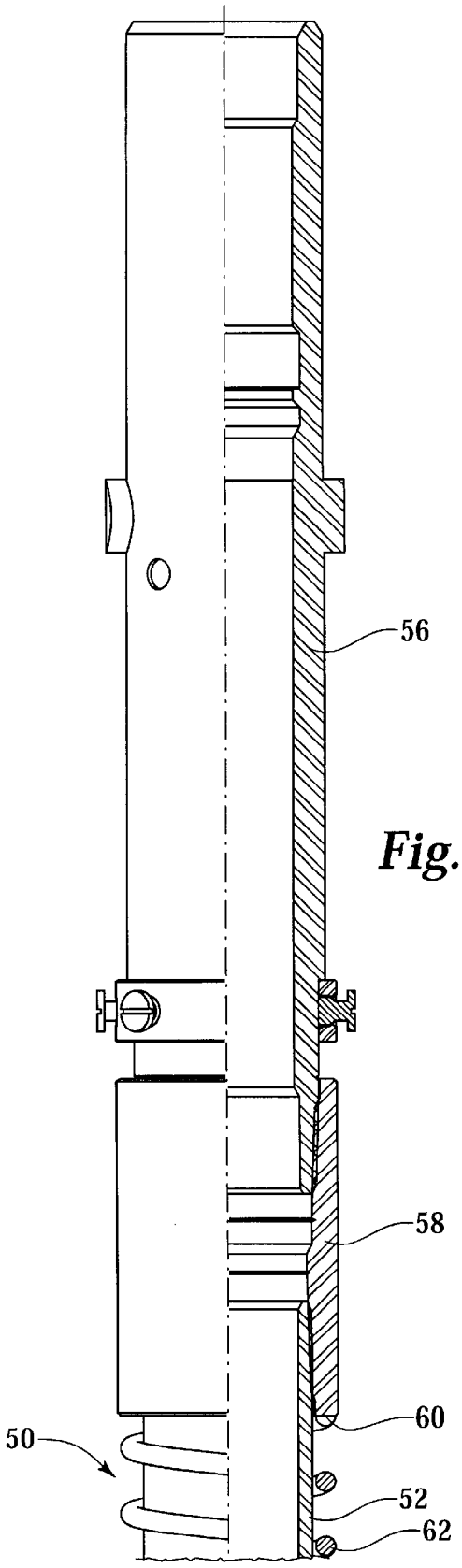
FIGS. 2A–2C are successive axial views in quarter section of a retrievable packer of the present invention.
Figure 2B:
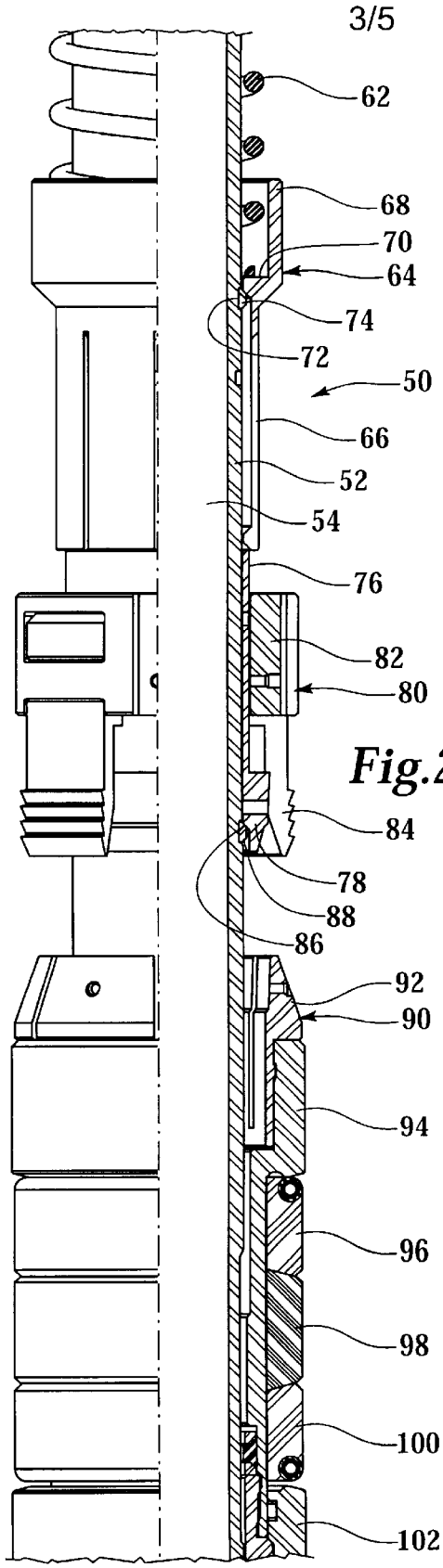
Figure 2C:
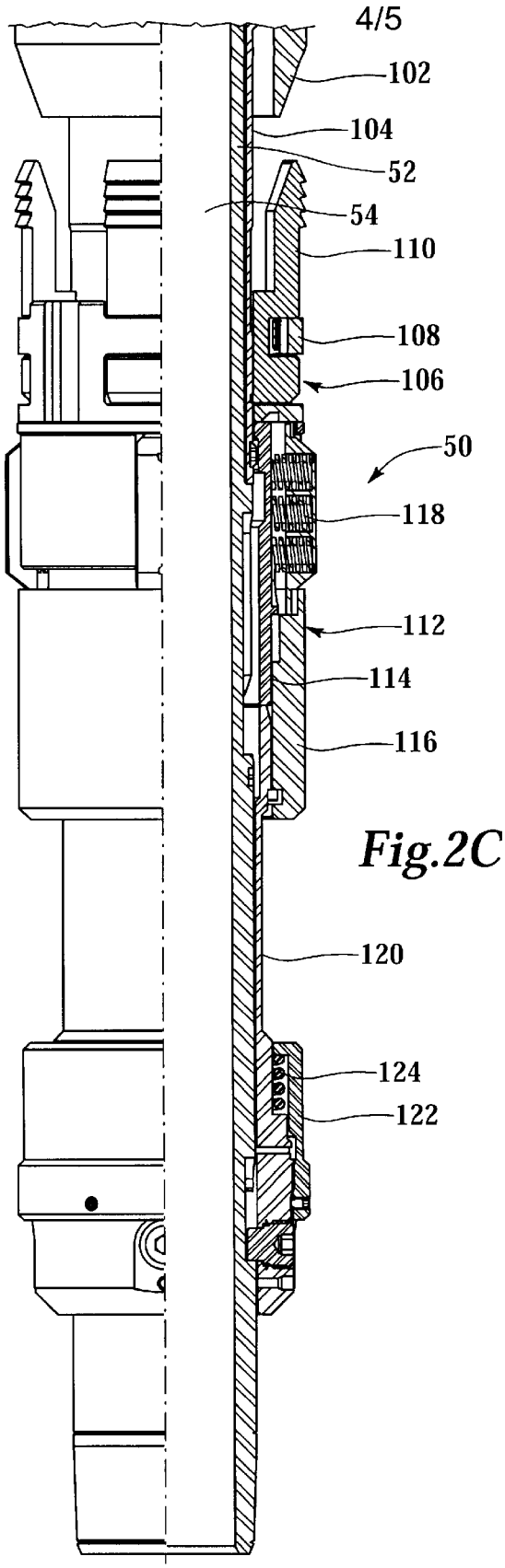

Referring now to FIG. 2, including FIGS. 2A–2C, therein is depicted a retrievable packer of the present invention that is generally designated 50. Packer 50 includes a substantially tubular, longitudinally extending mandrel 52 having a substantially cylindrical bore 54 defining a longitudinal production flow passageway. Mandrel 52 is coupled to a substantially tubular, longitudinally extending section of tubing 56 by a coupling 58. Coupling 58 includes a radially outwardly extending shoulder 60. Positioned around mandrel 52 is a spiral wound compression spring 62 that is operated against shoulder 60 of coupling 58.

Slidably positioned around mandrel 52 is a collet member 64. In the illustrated embodiment, collet member 64 includes eight collet fingers 66. As should be apparent to those skilled in the art, collet member 64 may have a variety of configurations including configurations having other numbers of collet fingers 66, such configurations being considered within the scope of the present invention. In the illustrated embodiment, collet member 64 also includes a spring cover 68 that extends upwardly to cover a portion of spring 62. It should be understood by those skilled in the art that collet member 64 could alternatively have a spring cover that entirely covers spring 62 or could have no spring cover associated therewith. Collet member 64 has an upper shoulder 70 that is in contact with the lower end of spring 62 such that spring 62 downwardly biases collet member 64.

While packer 50 is being described using directional terms such as above, below, upper, lower, upward, downward and the like, it should be apparent to those skilled in the art that the use of such terms is in relation to the illustrative embodiments as they are depicted in the figures, the upward direction being toward the top of the corresponding figure and the downward direction being toward the bottom of the corresponding figure.

Positioned around mandrel 52 in a groove 72 is a snap ring 74 that initially prevents collet member 64 from moving downwardly relative to mandrel 52. A support ring 76 is slidably disposed around mandrel 52 below collet fingers 66 of collet member 64. Support ring 76 has radially expanded end portion 78. Slidably positioned around support ring 76 is a slip assembly 80. Slip assembly 80 includes a slip carrier 82 and, in the illustrated embodiment, four radially extendable slips 84. As should be apparent to those skilled in the art, slip assembly 80 may have a variety of configurations including configurations having other numbers of slips 84, such configurations being considered within the scope of the present invention. Slips 84 each have a gripping outer surface for engaging and gripping the interior of the well casing in which packer 50 is disposed. Positioned around mandrel 52 in groove 86 is a snap ring 88 that initially prevents support ring 76 and slip assembly 80 from moving downwardly relative to mandrel 52.

Slidably positioned around mandrel 52 at a preselected distance below support ring 76 and slip assembly 80 is a slip wedge 90. In the illustrated embodiment, slip wedge 90 includes six wedge sections 92. As should be apparent to those skilled in the art, slip wedge 90 may have a variety of configurations including configurations having other numbers of wedge sections 92, such configurations being considered within the scope of the present invention. Wedge sections 92 each have a camming outer surface that will engage the inner surface of slips 84, as explained in greater detail below. The interior surface of wedge sections 92 has a mating profile that matches the mating profile on the outer surface of support ring 76 such that support ring 76 can be received in the recess between wedges sections 92 and mandrel 52, as explained in greater detail below.

Securably attached to slip wedge 90 and slidably positioned around mandrel 52 is a mandrel element 94. In the illustrated embodiment, three compressible seal elements 96, 98, 100 are positioned around mandrel element 94. Slidably and sealing positioned around mandrel element 94 below seal element 100 is a slip wedge 102 that has a camming outer surface. Collectively, mandrel element 94, seal elements 96, 98, 100 and slip wedge 102 may be considered a seal assembly. As explained in greater detail below, when a compressive force is generated between mandrel element 94 and slip wedge 102, seal elements 96, 98, 100 are radially expanded into contact with the well casing. Coupled to the lower end of mandrel element 94 and slidably positioned around mandrel 52 is a mandrel element extension 104.

Slidably positioned around mandrel element extension 104 at a preselected distance below slip wedge 102 is a slip assembly 106. Slip assembly 106 includes a slip carrier 108 and, in the illustrated embodiment, four radially extendable slips 110. As should be apparent to those skilled in the art, slip assembly 106 may have a variety of configurations including configurations having other numbers of slips 110, such configurations being considered within the scope of the present invention. Slips 110 have gripping outer surfaces for engaging and gripping the interior of the well casing in which packer 50 is disposed. Slips 110 each have an inner surface that engages the camming surface of slip wedge 102 as explained in greater detail below.

Positioned around mandrel 52 below slip assembly 106 is a drag block assembly 112. Drag block assembly 112 includes a drag block mandrel 114, a retainer 116 and four spring mounted drag blocks 118. As should be apparent to those skilled in the art, drag block assembly 112 may have a variety of configurations including configurations having other numbers of drag blocks 118, such configurations being considered within the scope of the present invention. Partially disposed within retainer 116 and slidably disposed around mandrel 52 is sleeve 120. Sleeve 120 has a housing 122 positioned around its lower end with a spring 124 positioned therebetween.

The operation of packer 50 is now described. Once packer 50 is attached within a work string, including for example tubing section 56, packer 50 is run downhole and located in the desired position with the well casing. A gripping and sealing relationship is established between the packer 50 and the well casing by mechanically shifting packer 50. Specifically, mandrel 52 of packer 50 is moved downwardly relative to slip assembly 106. Initially, slip wedge 102 travels with mandrel 52 until the camming surface of slip wedge 102 engage the inner surface of slips 110, which causes slips 110 to move radially outwardly into gripping engagement with well casing 34.

Figure 3A:
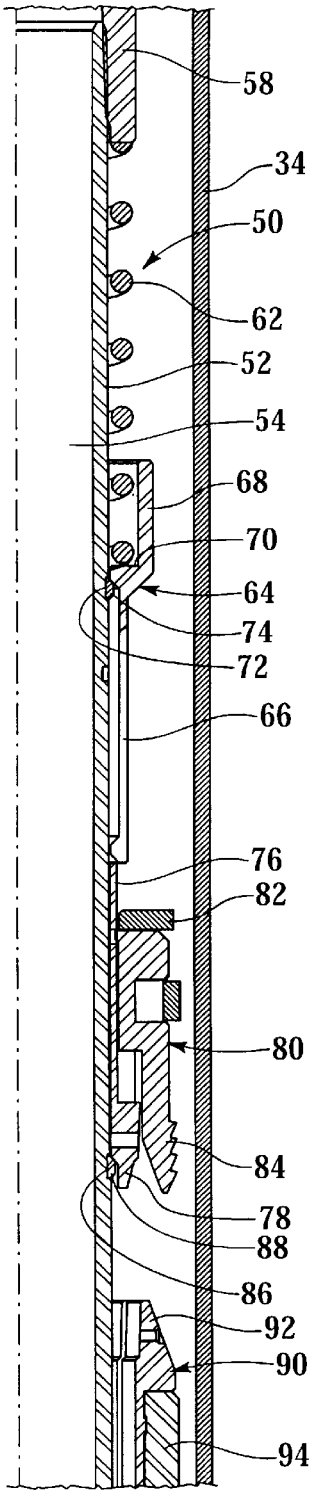
FIGS. 3A–3C are quarter sectional views of a retrievable packer of the present invention in its various positions.
Figure 3B:
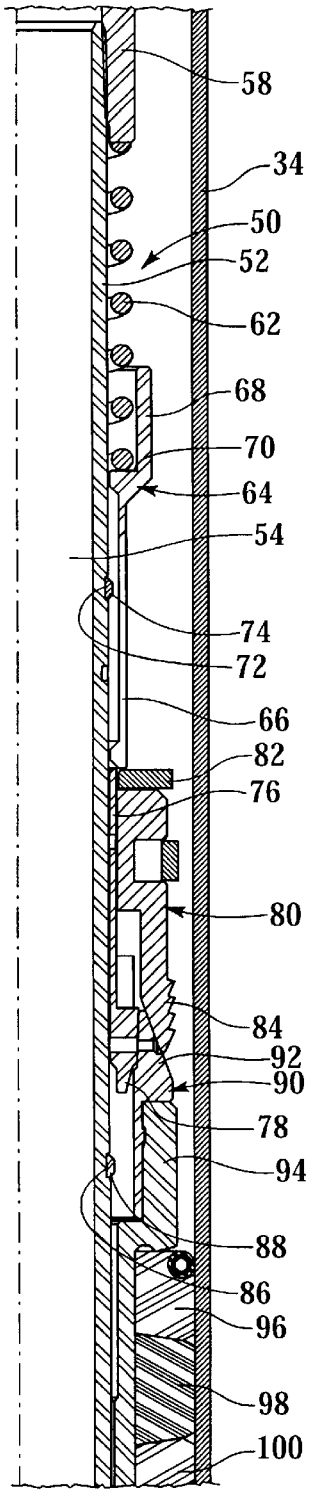
Figure 3C:
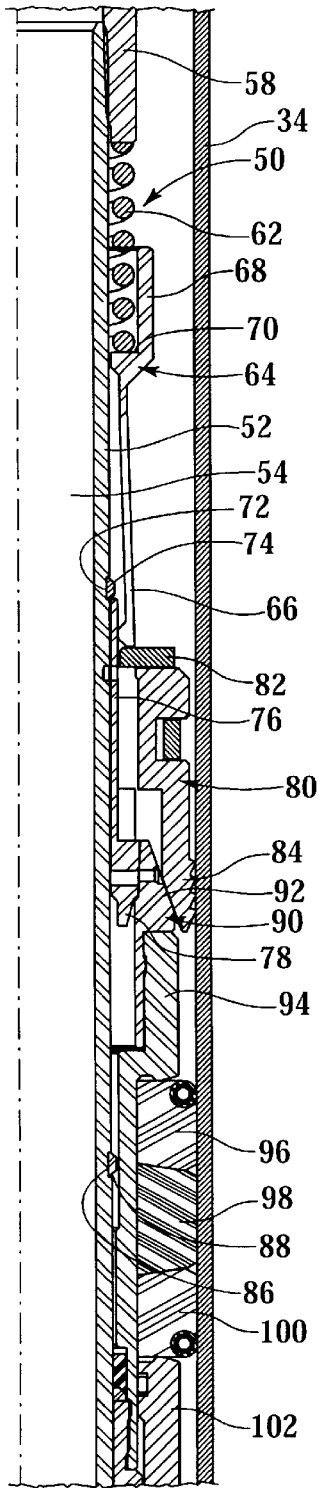

Referring in addition now to FIGS. 3A–3C, once slips 110 are set, mandrel 52 continues its downward travel which is now relative to not only slip assembly 106 but also to slip wedge 90, mandrel element 94, seal elements 96, 98, 100 and slip wedge 102. At this time, collet member 64, support ring 76 and slip assembly 80 continue to travel with mandrel 52 until the radially expanded end portion 78 of support ring 76 engages the inner surface of wedges sections 92 of slip wedge 90. Specifically, as the bias force of spring 62 is acting downwardly on collet member 64, collet fingers 66 positively operate against support ring 76 such that the radially expanded end portion 78 of support ring 76 slides between slip wedge 90 and mandrel 52, as best seen in FIG. 3B.

Continued downward travel of mandrel 52 now compresses seal elements 96, 98, 100 between mandrel element 94 and slip wedge 102 into a sealing engagement with well casing 34 due to the transmission of the spring force via collet member 64, support ring 76 and slip wedge 90. When the spring force reaches a sufficient level, for example, 50 to 75 percent of the maximum spring force, collet fingers 66 radially outwardly expand over the upper end of support ring 76 and come in contact with slip carrier 82. As best seen in FIG. 3C, once collet fingers 66 contact slip carrier 82, the spring force now downwardly operates on slip carrier 82 causing the inner surfaces of slips 84 to engage the camming surfaces of wedge sections 92 of slip wedge 90, which causes slips 84 to move radially outwardly into gripping engagement with well casing 34. In addition, the upper end of support ring 76 is contacted by snap ring 74. This configuration of packer 50 represents the set position in which packer 50 has a sealing and gripping relationship with well casing 34.

Importantly, it can be seen that due to the dual function of collet member 64 wherein the spring force of spring 62 is applied first to support ring 76 then to slip carrier 82, support ring 76 is properly positioned between slip wedge 90 and mandrel 52 before slips 84 engage slip wedge 90. This result is achieved regardless of the directional orientation of packer 50 as it does not rely on gravitational forces to position support ring 76 within slip wedge 90 but rather utilizes positive operation to assure proper positioning.

Once packer 50 is set within the well casing, packer 50 will provide its sealing and gripping functionality until it is desired to remove packer 50 from the well or reposition packer 50 within the well. The retrieval operation is initiated by rotating mandrel 52 a quarter turn which allows mandrel 52 to be moved upwardly. Specifically, this upward travel retracts collet member 64 which releases slips 84 from their gripping relationship with well casing 34. Next, snap ring 74 contacts collet member 64 and snap ring 88 contacts support ring 76 causing collet fingers 66 to return to their radially contracted configuration and causing support ring 76 to retract from between slip wedge 90 and mandrel 52.

This allows seal elements 96, 98, 100 to release from their sealing engagement with well casing 34. Further upward travel of mandrel 52 allows slip wedge 102 to retract from slips 100, which releases slips 110 from their gripping relationship with the well casing. Additional upward travel of mandrel 52 returns mandrel 52 to it initial configuration such that mandrel 52 may be retrieved to the surface or redeployed within the well following the setting procedure described above.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A retrievable packer for establishing a sealing and gripping engagement with a well casing disposed in a wellbore, the retrievable packer comprising:

a packer mandrel;

a seal assembly disposed about the packer mandrel, the seal assembly having a running position wherein the seal assembly is not in sealing engagement with the well casing and a sealing position wherein the seal assembly is in sealing engagement with the well casing;

a first slip wedge slidably disposed about the packer mandrel and operably associated with the slip assembly;

a support ring slidably disposed about the packer mandrel and operably positionable at least partially between the first slip wedge and the packer mandrel to prevent radially inward travel of the first slip wedge and to apply an axial force on the first slip wedge to operate the seal assembly from the running position to the sealing position;

a slip assembly slidably disposed about the support ring and operably associated with the first slip wedge, the slip assembly having a running position wherein the slip assembly is not in gripping engagement with the well casing and a gripping position wherein the slip assembly is radially outwardly extended by contact with the first slip wedge into gripping engagement with the well casing; and a collet member slidably disposed about the packer mandrel and having a first operating position wherein the collet member applies an axial force on the support ring to positively position the support ring at least partially between the first slip wedge and the packer mandrel and a second operating position wherein the collet member applies an axial force on the slip assembly to operate the slip assembly from the running position to the gripping position.

2. The retrievable packer as recited in claim 1 wherein the seal assembly further comprises a mandrel element slidably disposed about the packer mandrel, a second slip wedge slidably disposed about the mandrel element and at least one seal element disposed about the mandrel element such that a compressive force between the mandrel element and the second slip wedge radially expands the seal element.

3. The retrievable packer as recited in claim 1 wherein the first slip wedge further comprises a plurality of wedge sections.

4. The retrievable packer as recited in claim 1 wherein the support ring further comprises a radially expanded end portion that is operably positionable between the first slip wedge and the packer mandrel.

5. The retrievable packer as recited in claim 1 wherein the slip assembly further comprises a slip carrier and a plurality of slips that are radially outwardly extendable by contact with the first slip wedge into gripping engagement with the well casing.

6. The retrievable packer as recited in claim 1 wherein the collet member further comprises a plurality of collet fingers that are radially retracted when the collet member is in the first operating position and radially expanded when the collet member is in the second operating position.

7. The retrievable packer as recited in claim 1 wherein the collet member further comprises a spring cover.

8. The retrievable packer as recited in claim 1 wherein the seal assembly can be repetitively operated between the running position and the sealing position without removing the packer from the well casing.

9. The retrievable packer as recited in claim 8 wherein the seal assembly will maintain the sealing engagement with the well casing each time the seal assembly is operated to the sealing position.

10. The retrievable packer as recited in claim 1 wherein the slip assembly can be repetitively operated between the running position and the gripping position without removing the packer from the well casing.

11. A retrievable packer for establishing a sealing and gripping engagement with a well casing disposed in a wellbore, the retrievable packer comprising:

a packer mandrel;

a seal assembly disposed about the packer mandrel, the seal assembly having running and sealing positions;

a first slip wedge slidably disposed about the packer mandrel and operably associated with the slip assembly;

a support ring slidably disposed about the packer mandrel and operably positionable at least partially between the first slip wedge and the packer mandrel to apply an axial force on the first slip wedge to operate the seal assembly from the running position to the sealing position;

a slip assembly slidably disposed about the support ring and operably associated with the first slip wedge, the slip assembly having running and gripping positions; and a collet member slidably disposed about the packer mandrel and having a first operating position wherein the collet member applies an axial force on the support ring to positively position the support ring at least partially between the first slip wedge and the packer mandrel and a second operating position wherein the collet member applies an axial force on the slip assembly to operate the slip assembly from the running position to the gripping position.

12. The retrievable packer as recited in claim 11 wherein the seal assembly further comprises a mandrel element slidably disposed about the packer mandrel, a second slip wedge slidably disposed about the mandrel element and at least one seal element disposed about the mandrel element such that a compressive force between the mandrel element and the second slip wedge radially expands the seal element.

13. The retrievable packer as recited in claim 11 wherein the first slip wedge further comprises a plurality of wedge sections.

14. The retrievable packer as recited in claim 11 wherein the support ring further comprises a radially expanded end portion that is operably positionable between the first slip wedge and the packer mandrel.

15. The retrievable packer as recited in claim 11 wherein the slip assembly further comprises a slip carrier and a plurality of slips that are radially outwardly extendable by contact with the first slip wedge into gripping engagement with the well casing.

16. The retrievable packer as recited in claim 11 wherein the collet member further comprises a plurality of collet fingers that are radially retracted when the collet member is in the first operating position and radially expanded when the collet member is in the second operating position.

17. The retrievable packer as recited in claim 11 wherein the collet member further comprises a spring cover.

18. The retrievable packer as recited in claim 11 wherein the seal assembly can be repetitively operated between the running position and the sealing position without removing the packer from the well casing.

19. The retrievable packer as recited in claim 18 wherein the seal assembly will maintain the sealing engagement with the well casing each time the seal assembly is operated to the sealing position.

20. The retrievable packer as recited in claim 11 wherein the slip assembly can be repetitively operated between the running position and the gripping position without removing the packer from the well casing.

21. A retrievable packer comprising a collet member slidably disposed about a packer mandrel and having a first operating position wherein the collet member applies an axial force on a support ring that is slidably disposed about the packer mandrel to positively position the support ring at least partially between the packer mandrel and a first slip wedge that is slidably disposed about the packer mandrel to set a seal assembly that is slidably disposed about the packer mandrel and a second operating position wherein the collet member applies an axial force on a slip assembly that is slidably disposed about the support ring to set the slip assembly.

22. The retrievable packer as recited in claim 21 wherein the seal assembly has a running position wherein the seal assembly is not in sealing engagement with a well casing and a sealing position wherein the seal assembly is in sealing engagement with the well casing.

23. The retrievable packer as recited in claim 21 wherein the seal assembly further comprises a mandrel element slidably disposed about the packer mandrel, a second slip wedge slidably disposed about the mandrel element and at least one seal element disposed about the mandrel element such that a compressive force between the mandrel element and the second slip wedge radially expands the seal element.

24. The retrievable packer as recited in claim 21 wherein the first slip wedge is operably associated with the slip element.

25. The retrievable packer as recited in claim 21 wherein the first slip wedge further comprises a plurality of wedge sections.

26. The retrievable packer as recited in claim 21 wherein the support ring further comprises a radially expanded end portion that is operably positionable between the first slip wedge and the packer mandrel.

27. The retrievable packer as recited in claim 21 wherein the slip assembly has a running position wherein the slip assembly is not in gripping engagement with a well casing and a gripping position wherein the slip assembly is radially outwardly extended by contact with the first slip wedge into gripping engagement with the well casing.

28. The retrievable packer as recited in claim 21 wherein the slip assembly further comprises a slip carrier and a plurality of slips that are radially outwardly extendable by contact with the first slip wedge into gripping engagement with a well casing.

29. The retrievable packer as recited in claim 21 wherein the collet member further comprises a plurality of collet fingers that are radially retracted when the collet member is in the first operating position and radially expanded when the collet member is in the second operating position.

30. The retrievable packer as recited in claim 21 wherein the collet member further comprises a spring cover.

31. The retrievable packer as recited in claim 21 wherein the seal assembly can be repetitively set without removing the packer from a well casing.

32. The retrievable packer as recited in claim 31 wherein the seal assembly will maintain a sealing engagement with a well casing each time the seal assembly is set.

33. The retrievable packer as recited in claim 21 wherein the slip assembly can be repetitively set without removing the packer from a well casing.

34. A method of repeatedly setting a retrievable packer to establish a sealing and gripping engagement with a well casing, the method comprising:

lowering the packer into the well casing to a selected location;

setting the packer by axially shifting a packer mandrel such that a collet member that is slidably disposed about the packer mandrel first applies an axial force on a support ring to positively position the support ring at least partially between a first slip wedge and the packer mandrel to set a seal assembly and second applies an axial force on a slip assembly to set the slip assembly, thereby establishing a sealing and gripping engagement with the well casing;

unsetting the packer by retracting the seal assembly and the slip assembly; and resetting the packer at least one additional time in the well casing thereby reestablishing the sealing and gripping engagement with the well casing.

35. The method as recited in claim 34 wherein setting the seal assembly further comprises applying a compressive force between a mandrel element and a second slip wedge on a seal element to radially expand the seal element.

36. The method as recited in claim 34 further comprising the step of repositioning the collet member from applying the axial force on the support ring to applying the axial force on the slip assembly by radially expanding a plurality of collet fingers.

37. The method as recited in claim 34 further comprising the step of maintaining the sealing engagement with the well casing each time the seal assembly is set.

38. A method of setting a retrievable packer to establish a sealing and gripping engagement with a well casing, the method comprising:

lowering the packer into the well casing to a selected location;

axially shifting a packer mandrel within the packer;

positively positioning a support ring at least partially between a first slip wedge and the packer mandrel by applying an axial force on the support ring with a collet member;

operating a seal assembly from a running position wherein the seal assembly is not in sealing engagement with the well casing to a sealing position wherein the seal assembly is in sealing engagement with the well casing;

repositioning the collet member to apply the axial force on a slip assembly; and operating the slip assembly from a running position wherein the slip assembly is not in gripping engagement with the well casing to a gripping position wherein the slip assembly is radially outwardly extended by contact with the first slip wedge into gripping engagement with the well casing.

39. The method as recited in claim 38 wherein the step of operating a seal assembly further comprises applying a compressive force between a mandrel element and a second slip wedge on a seal element to radially expand the seal element.

40. The method as recited in claim 38 wherein the step of repositioning the collet member further comprises radially expanding a plurality of collet fingers.

41. The method as recited in claim 38 further comprising the step of repetitively operating the seal assembly between the running position and the sealing position without removing the packer from the well casing.

42. The method as recited in claim 41 further comprising the step of maintaining the sealing engagement with the well casing each time the seal assembly is operated to the sealing position.

43. The method as recited in claim 38 further comprising the step of repetitively operating the slip assembly between the running position and the gripping position without removing the packer from the well casing.

* * * * *